US007497386B2

(12) United States Patent
Donnelly et al.

(10) Patent No.: US 7,497,386 B2
(45) Date of Patent: Mar. 3, 2009

(54) APPARATUS AND METHODS FOR OPERATING A GAS VALVE

(75) Inventors: Donald E. Donnelly, Fenton, MO (US); Thomas J. Fredricks, Wildwood, MO (US)

(73) Assignee: Emerson Electric Co., St. Louis, MO (US)

( * ) Notice: Subject to any disclaimer, the term of this patent is extended or adjusted under 35 U.S.C. 154(b) by 484 days.

(21) Appl. No.: 10/863,320

(22) Filed: Jun. 8, 2004

(65) Prior Publication Data

US 2005/0269420 A1 Dec. 8, 2005

(51) Int. Cl.
*G05D 23/27* (2006.01)
*F23N 5/20* (2006.01)

(52) U.S. Cl. ..... 236/15 BG; 236/72; 236/78 R; 431/18; 431/75

(58) Field of Classification Search ..... 236/15 BG, 236/15 BR, 15 R, 67, 72, 78 R; 431/18, 431/75, 80; 251/129.09
See application file for complete search history.

(56) References Cited

U.S. PATENT DOCUMENTS

| | | | | |
|---|---|---|---|---|
| 4,025,283 | A * | 5/1977 | Ray | 431/45 |
| 4,204,833 | A * | 5/1980 | Kmetz et al. | 431/22 |
| 4,360,338 | A * | 11/1982 | Katchka | 431/46 |
| 4,770,629 | A * | 9/1988 | Bohan, Jr. | 431/59 |
| 6,257,871 | B1 * | 7/2001 | Weiss et al. | 431/20 |
| 6,261,087 | B1 * | 7/2001 | Bird et al. | 431/80 |
| 6,295,951 | B1 * | 10/2001 | Valcic et al. | 122/13.01 |
| 6,698,386 | B1 * | 3/2004 | Hoffman | 122/14.31 |
| 6,701,874 | B1 | 3/2004 | Schultz et al. | |
| 2002/0073985 | A1 * | 6/2002 | Leukhardt et al. | 126/39 E |

* cited by examiner

*Primary Examiner*—Marc E Norman
(74) *Attorney, Agent, or Firm*—Harness, Dickey & Pierce, P.L.C.

(57) ABSTRACT

An apparatus for operating a gas valve in a gas-fired heating system includes a solenoid having a pick coil and a hold coil connected to the pick coil and to a thermo-generator. A power supply powers the pick coil to open the gas valve. The thermo-generator powers the hold coil to hold the gas valve open. The apparatus is small and inexpensive compared to systems that use DC-DC converters and/or stepper motors to operate a millivolt valve. A millivolt valve can be operated via power from a heater thermostat, without AC power having to be wired to the heater.

40 Claims, 2 Drawing Sheets

APPARATUS AND METHODS FOR OPERATING A GAS VALVE

FIELD OF THE INVENTION

The present invention relates generally to gas furnaces and, more particularly, to an apparatus for operating a gas valve in a millivolt heating system such as a water heater.

BACKGROUND OF THE INVENTION

Gas-powered furnace systems such as water heaters commonly are millivolt systems in which a thermo-generator or thermopile supplies low-voltage power for operating a gas valve. The thermo-generator typically has wires of dissimilar metals that produce a voltage when heated together in a furnace pilot flame. A millivolt gas valve typically has a solenoid or magnetic coil that can be actuated to open the valve and keep it open for as long as needed. When the coil is actuated, it "pulls in" a valve member from an opening in the valve so as to allow the flow of gas through the valve. When current to the coil is stopped, the valve member returns to its normal position and thus closes the valve.

A magnetic actuator for a gas valve must be strong enough to open the gas valve to a gas port and also to hold the valve open for the duration of a call for heat. A magnetic actuator typically uses about twice as much power to open a gas valve as it does to keep the valve in an open position. Thus the coil needs to be large enough to be able to utilize enough power from the thermo-generator to open the gas valve, even though only half as much power typically is needed to hold the valve open. Space requirements and costs, however, increase with coil size.

SUMMARY OF THE INVENTION

The present invention, in one embodiment, is directed to an apparatus for operating a gas valve that supplies gas to a burner in a gas-fired heating system. The apparatus includes a solenoid having a pick coil and a hold coil connected to the pick coil and to a thermo-generator. The apparatus also includes a power supply connected to the pick coil. The pick coil is powered via the power supply to open the gas valve, and the hold coil is powered by the thermo-generator to hold the gas valve open.

Embodiments of the above apparatus are small and inexpensive compared to existing systems that make use of costly DC-DC converters and/or stepper motors to open and close a millivolt valve. A millivolt gas valve can be operated, for example, via power from a water heater thermostat, without AC power having to be wired to the heater.

Further areas of applicability of the present invention will become apparent from the detailed description provided hereinafter. It should be understood that the detailed description and specific examples, while indicating embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

The following description of embodiments of the invention is merely exemplary in nature and is in no way intended to limit the invention, its application, or uses. Although embodiments of the present invention are described in connection with a gas water heater, the invention is not so limited. The invention can be practiced in connection with other gas-powered systems, including but not limited to gas log fireplaces and room heaters and furnaces.

Figure 1:
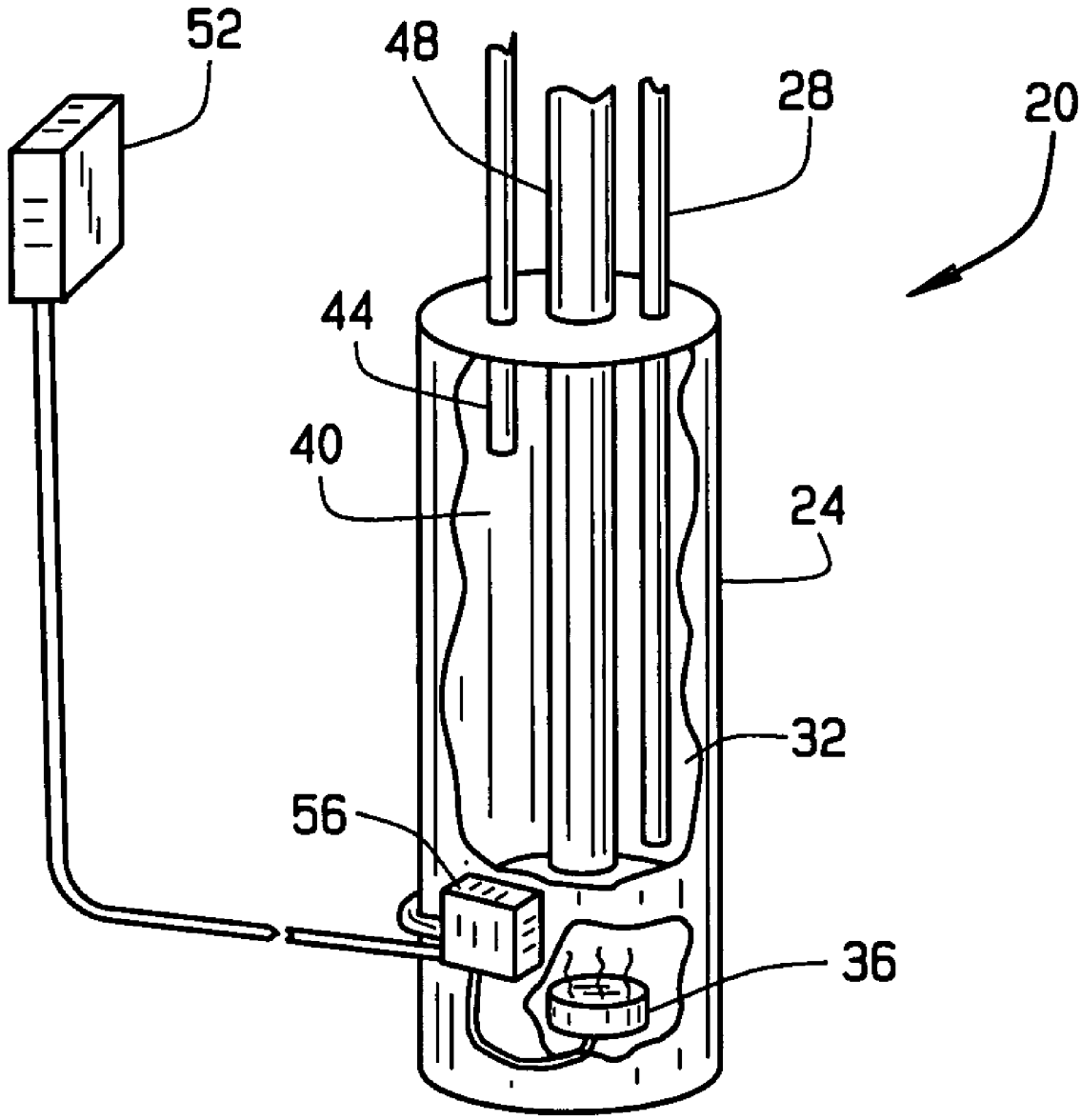
FIG. 1 is a perspective view of a water heater according to one embodiment of the present invention, with portions cut away to expose a burner and the interior of a tank.

A gas water heater according to one embodiment of the present invention is indicated generally by reference number 20 in FIG. 1. The heater 20 has a tank 24 into which cold water enters via a cold water pipe 28. Cold water entering the bottom 32 of the tank is heated by a gas burner 36 beneath the tank. The burner 36 can be lighted using a pilot flame (not shown in FIG. 1). Heated water rises to the top 40 of the tank and leaves the tank via a hot water pipe 44. Combustion gases leave the heater via a flue 48.

A thermostat 52 signals a gas valve 56 to control gas flow to the burner 36 as further described below. The thermostat 52 may be remote from the heater 20, as shown in FIG. 1. Embodiments are contemplated, however, wherein the thermostat is integral to the heater.

Figure 2:
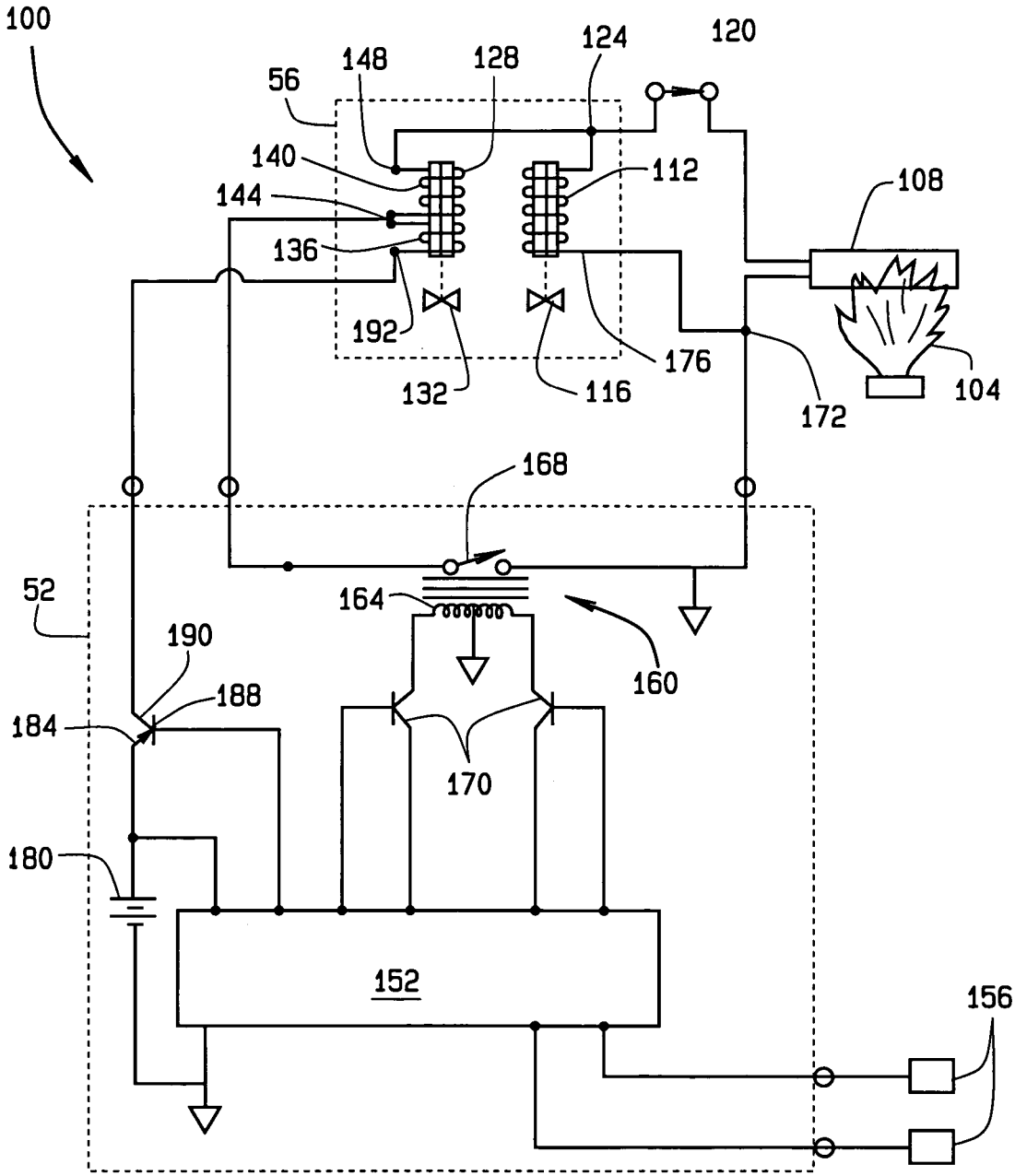
FIG. 2 is a schematic diagram of an apparatus for operating a gas valve according to one embodiment of the present invention.

An embodiment of an apparatus for operating a gas valve, for example, in the heater 20, is indicated generally by reference number 100 in FIG. 2. A pilot flame 104 used for lighting the burner 36 also powers a thermo-generator 108. The thermo-generator 108 converts heat into electrical current which is deliverable to a solenoid 112. A pilot valve 116, after having been manually opened by a user of the heater, is kept open by the solenoid 112 to maintain gas flow to the pilot flame. An emergency cut-off (ECO) device 120 preferably is connected in series between a node 124 and the thermo-generator 108.

Electrical current is carried from the thermo-generator 108 to the solenoid 112 and to a dual-winding solenoid 128 via the node 124. As shall be further described below, the solenoid 128 opens and closes a main valve 132 of the gas valve 56 during operation of the heater. The solenoid 128 includes a pull-in or pick coil 136 electrically connected to a hold coil 140 at a tap 144. As shall also be discussed further below, the solenoid 128 preferably is small and preferably is mounted in an enclosure in which other gas-controlling elements of the heater are mounted. An outer end 148 of the hold coil 140 is electrically connected to the thermo-generator 108 via the node 124.

The thermostat 52 includes a microprocessor 152 that receives temperature information from temperature sensors 156 located, for example, in the top 40 and bottom 32 of the water tank 24. A latching relay 160, when closed, electrically connects the thermostat 52 and components of the gas valve 56 as further described below. The latching relay 160 has a grounded latch coil 164 and a magnetic latch 168. While current flows through the grounded latch coil 164 in one direction under control of the microprocessor 152, the magnetic latch 168 is pulled toward the grounded latch coil 164 and closes the latching relay 160. When current is reversed to flow through the grounded latch coil 164 in the opposite direction under control of the microprocessor 152, the magnetic latch 168 is repelled by the grounded latch coil 164 and opens the latching relay 160. The latching relay 160 is preferably an Arromat (NAIS) TX2-L2 manufactured by Arromat.

The grounded latch coil 164 is connected between a pair of transistor switches 170 connected to and controlled by the microprocessor 152. The microprocessor 152 uses the transistor switches 170 to control the direction of current flow through the latch coil 164. The transistor is preferably a type 2N3904 manufactured by On Semiconductor. The magnetic latch 168, when closed, electrically connects the tap 144 with a node 172 between the thermo-generator 108 and an end 176 of the pilot solenoid 112.

A battery 180 connected across the microprocessor 152 supplies, for example, a voltage of about 3 volts. The battery 180 is connected to the emitter terminal 184 of a pnp transistor 188 controlled by the microprocessor 152. The transistor is preferably a type 2N3904 manufactured by On Semiconductor. The collector terminal 190 of the transistor 188 is connected to an outer end 192 of the pick coil 136. Although the battery 180 is internal to the thermostat 52 in the present embodiment, in another embodiment the battery can be remote from the thermostat. In yet another embodiment, another DC source may be used instead of a battery.

As previously mentioned, the solenoid 128 is preferably small. As a specific example, the pick coil 136 can have about 100 ampere-turns, and the hold coil 140 can have about 40 ampere-turns. Where the battery 180 or other DC voltage source provides about 3 volts, the pick coil 136 can have, for example, about 700 turns of AWG number 35 magnet wire. With approximately a 2-ohm load, the thermo-generator 108 typically provides about 300 milli-volts or 150 milli-amperes. Accordingly, where the hold coil 140 is of magnet wire having about 24 feet per pound, the hold coil 140 can have, for example, 220 turns of AWG number 29 magnet wire.

When the heater 20 is in operation, input from the sensors 156 may prompt the thermostat 52 to issue a call for heat. In such event, the microprocessor 152 causes current to flow through the latch relay coil 164 in a predetermined direction so as to cause the latching relay 160 to close. When the latch is closed, the battery 180 is electrically connected in a "pull-in" circuit, via which current can flow through the transistor 188 and the pick coil 136 to ground. Current also flows to the hold coil 140, the solenoid 112, the ECO 120, the thermo-generator 108 to ground.

After the "pull-in" circuit is closed, the microprocessor 152 supplies a pulse from the battery 180 via the transistor 188, through the pick coil 136. The voltage pulse through the pick coil 136 causes the solenoid 128 to retract or "pull in" a valve member (not shown) relative to the main valve 132, so that the main valve 132 is opened to allow the flow of gas to the burner 36. The duration of the pull-in pulse from the battery 180 is, for example, about 10 milliseconds. When the valve member has been "pulled in" and the pulse has ended, the latch remains closed until opened again as further described below. While the latch 160 is closed, it is part of a "hold-in" circuit, via which current can flow through the thermo-generator 108, the hold coil 140, the pilot solenoid 112 and the ECO 120. The thermo-generator 108 provides sufficient voltage to the hold coil 140 to hold open the main valve 132. Thus gas continues to flow through the valve 132 to the burner 36 for the duration of a call for heat.

When the microprocessor 152 determines, for example, from input from temperature sensors 156 that a call for heat is to be ended, it signals the switch transistors 170 to cause a reversal of polarity of the voltage across the latch coil 164. The latch 168 thus is caused to open and break the electrical connection between the hold coil 140 and the thermo-generator 108. The open-circuited hold coil 140 allows the valve member to close the main valve 132, which remains closed until a subsequent call for heat.

The foregoing apparatus allows a millivolt gas valve to be operated at lower energy and in less space than previously possible. Because a very small solenoid can be used, magnetic actuating device complexity and tolerances are greatly reduced. Thus the device is significantly less expensive than an actuating device that must be powered by the thermo-generator for valve "pull-in". The gas valve can be operated via power from the thermostat, and under control of a microprocessor in the thermostat. The above gas valve operating apparatus is small, inexpensive and can be used with a gas water heater that is operated mechanically. There is no need to wire AC power to the heater, nor is there any need to install costly DC-DC converters or stepper motors.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An apparatus for operating a gas valve that supplies gas to a burner in a gas-fired heating system, the apparatus comprising:

a solenoid for operating a movable valve, which is operatively moved to an open position by application of a battery voltage for a momentary duration to a pick coil and operatively held in an open position so long as a thermo-generator voltage source is connected to a hold coil, wherein interruption of thermo-generator connection to the hold coil causes the movable valve to move to a closed position;

a battery power supply;

a thermo-generator voltage source; and a thermostat operable to connect the battery power supply voltage to the pick coil for a momentary duration, and operable to activate a switch to connect the thermo-generator voltage source to the hold coil, wherein the pick coil is powered via the battery power supply to open the gas valve, and the hold coil is powered by the thermo-generator to hold the gas valve open until the thermostat causes the switch to interrupt the thermo-generator connection to the hold coil.

2. The apparatus of claim 1 further comprising:

a tap at which the pick coil and hold coil are connected; and a relay between the tap and the thermo-generator.

3. The apparatus of claim 2 wherein the relay comprises a latching relay of a thermostat.

4. The apparatus of claim 3 further comprising a processor of the thermostat configured to momentarily activate the switch to power the pick coil by pulsing the power supply.

5. The apparatus of claim 4 further comprising a pair of switches and a relay coil connected between the switches, wherein the processor is further configured to reverse a current through the relay coil using the switches.

6. The apparatus of claim 3 wherein the latching relay comprises a grounded coil with which the power supply is grounded while the relay is closed.

7. The apparatus of claim 1 wherein the power supply comprises a voltage supply configured to pulse the pick coil.

8. The apparatus of claim 1, wherein the power supply comprises at least one battery.

9. An apparatus for operating a gas valve that supplies gas to a burner in a gas-fired heating system, the apparatus comprising:

a movable valve that is operatively pulled to an open position by application of a battery voltage for a momentary duration to a pick coil, and operatively held in an open position so long as a thermo-generator voltage source is connected to a hold coil;

a pull-in circuit having a pick coil and a battery power supply configured to power the pick coil; and a hold-in circuit having a thermo-generator and a hold coil powered by the thermo-generator;

a thermostat operable to connect the battery power supply in the pull-in circuit to the pick coil for a momentary duration, and operable to switch a relay to connect the thermo-generator in the hold-in circuit to the hold coil.

10. The apparatus of claim 9 wherein the relay is grounded relative to the battery power supply.

11. The apparatus of claim 9 wherein the thermostat is powered by the battery power supply and has a processor that pulses a switch to momentarily connect the battery power supply to pulse the pull-in circuit.

12. The apparatus of claim 9 wherein the relay is configured to open to disconnect the thermo-generator in the hold-in circuit to the hold coil and close the gas valve.

13. The apparatus of claim 9 further comprising a tap between the pick coil and hold coil, the tap connected with the relay.

14. The apparatus of claim 13 further comprising a pilot solenoid connected with the tap.

15. The apparatus of claim 9 wherein the power supply is pulsed to cause the pick coil to open the gas valve.

16. The apparatus of claim 9 wherein the thermostat that is operable to switch a relay comprises the relay.

17. The apparatus of claim 9, wherein the power supply comprises at least one battery.

18. A gas-powered heating system having a gas valve that supplies gas to a burner under control of a solenoid, the system comprising:

a solenoid valve that is operatively moved to an open position by application of a battery voltage for a momentary duration to a pick coil, and operatively held in an open position so long as a thermo-generator voltage source is connected to a hold coil;

a first circuit having a power supply and a pick coil of the solenoid, which is connected to the power supply by a switch;

a second circuit having a thermo-generator and a hold coil of the solenoid, which is connected to the thermo-generator by a relay;

a thermostat for controlling the switch and the relay, wherein the thermostat activates the switch for a momentary duration to cause the battery power supply to activate the pick coil to open the gas valve, and activates the relay to cause the thermo-generator to power the hold coil to hold the gas valve open, and further deactivates the relay to interrupt the thermo-generator connection to the hold coil to move the valve to a closed position.

19. The system of claim 18 wherein said relay is a relay of the thermostat.

20. The system of claim 19 wherein the relay is further configured to connect the thermo-generator in the second circuit to power the hold coil.

21. The system of claim 20 wherein the relay is further configured to disconnect the thermo-generator from the second circuit to close the gas valve.

22. The system of claim 19 further comprising a tap between the pick and hold coils, the tap connecting the hold coil with the thermo-generator via the relay.

23. The system of claim 19 further comprising a processor configured to reverse a polarity of current through the relay, to cause the relay to disconnect the thermo-generator from the hold coil.

24. The system of claim 23 further comprising at least one temperature sensor, wherein the processor is further configured to control the thermostat based on input from the sensor.

25. The gas powered heating system of claim 18, wherein the power supply comprises at least one battery.

26. A gas-powered heating system having a gas valve that supplies gas to a burner under control of a solenoid, a thermostat having a power supply, and a pilot valve powered by a thermo-generator, the system comprising:

a thermostat having a battery power supply therein;

a thermo-generator voltage source;

a solenoid having a movable valve that is operatively moved to an open position by application of a battery voltage for a momentary duration to a pick coil, and operatively held in an open position so long as a thermo-generator voltage source is connected to a hold coil;

a pick coil of the solenoid configured to open the gas valve when connected to the battery power supply by a switch;

a hold coil of the solenoid configured to hold the gas valve open when connected to the thermo-generator by a relay; and wherein the thermostat operates the switch to connect the battery power supply to power the pick coil via the power supply and operates the relay to connect the thermo-generator to power the hold coil via the thermo-generator.

27. The system of claim 26 wherein the relay connects the hold coil of the gas valve and the battery power supply of the thermostat.

28. The system of claim 26 wherein the relay is further configured to disconnect the thermo-generator from the hold coil to close the gas valve.

29. The system of claim 26 wherein the pick coil is grounded relative to the battery power supply through the relay.

30. The gas powered heating system of claim 26, wherein the power supply comprises at least one battery.

31. The gas powered heating system of claim 30, wherein the relay is configured to be switched to supply power the pick coil from the battery power supply to thereby open the valve, and to be switched to disconnect power the hold coil from the thermo-generator to thereby close the valve.

32. A method of operating a gas valve that supplies gas to a furnace under control of a thermostat, the flow of gas through the gas valve controlled via a hold coil connected to a thermo-generator that supplies power to the hold coil to hold the gas valve open, the method comprising:

closing a latching relay to establish a ground connection for a pull-in circuit that includes a battery voltage supply and a pick coil configured to open the gas valve when pulsed by connection for a momentary duration to the battery voltage supply, and to establish connection of the thermo-generator to the hold coil; and switching a switch to connect the battery power supply to the pick coil for a momentary duration, for supplying a pulse from the battery voltage supply to the pick coil, to thereby cause the pick coil to move the gas valve to an open position, and the hold coil connected to the thermo-generator to hold the gas valve open.

33. The method of claim 32 further comprising the step of maintaining the latching relay closed to hold the gas valve open via the closed relay and the thermo-generator.

34. The method of claim 32, wherein the closing of the latching relay and switching of the switch are performed by a processor of the thermostat.

35. The method of claim 32 further comprising the step of opening the relay to interrupt the connection of the thermo-generator to the hold coil and close the gas valve.

36. The method of claim 35 wherein opening the relay comprises reversing a polarity of current through the relay.

37. The method of claim 32, wherein the power supply comprises at least one battery.

38. A gas-fired heater having a gas valve that supplies gas to a burner, and a thermo-generator that supplies power for operating a pilot valve, the heater comprising:

a solenoid having a pick coil connected to a switch for switching a battery power source to the pick coil, and a hold coil connected with a relay for connecting the hold coil to a thermo-generator;

wherein the pick coil is powered by the power supply to open the gas valve, and the hold coil is powered by the thermo-generator through the relay to hold the gas valve open; and a thermostat for controlling the switch and the relay, wherein the thermostat activates the switch for a momentary duration to cause the battery power supply to activate the pick coil to open the gas valve, and activates the relay to cause the thermo-generator to power the hold coil to hold the gas valve open, and further deactivates the relay to interrupt the thermo-generator connection to the hold coil to move the valve to a closed position.

39. The gas-fired heater of claim 38, wherein the power supply comprises at least one battery.

40. The gas-fired heater of claim 38, wherein the relay is configured to be switched to supply power the pick coil from the battery power supply to thereby open the valve, and to be switched to disconnect power the hold coil from the thermo-generator to thereby close the valve.

* * * * *